US009446883B2

(12) United States Patent
Schlipper

(10) Patent No.: US 9,446,883 B2
(45) Date of Patent: Sep. 20, 2016

(54) FALL ARREST SAFETY NET

(71) Applicant: MRM HK LTD, Hong Kong (HK)

(72) Inventor: Robert Wesley Schlipper, Hong Kong (HK)

(73) Assignee: MRM HK LIMITED, Hong Kong (HK)

( * ) Notice: Subject to any disclaimer, the term of this patent is extended or adjusted under 35 U.S.C. 154(b) by 238 days.

(21) Appl. No.: 13/987,804

(22) Filed: Sep. 4, 2013

(65) Prior Publication Data

US 2014/0105522 A1 Apr. 17, 2014

Related U.S. Application Data

(63) Continuation-in-part of application No. 12/460,245, filed on Jul. 16, 2009, now Pat. No. 8,714,308.

(51) Int. Cl.
*B65D 30/00* (2006.01)
*E04G 21/32* (2006.01)

(52) U.S. Cl.
CPC ..... *B65D 29/00* (2013.01); *E04G 21/3261* (2013.01)

(58) Field of Classification Search
CPC ..... E04G 21/3261; E04G 21/3266; F16M 13/00; F16M 13/027; Y10T 24/39; B65D 29/00
See application file for complete search history.

(56) References Cited

U.S. PATENT DOCUMENTS 107,952 A 10/1870 Osborn
363,113 A * 5/1887 Burrell et al. ..... B66C 1/127 119/728
363,495 A 5/1887 Wilson, Jr.
656,431 A 8/1900 Stewart
790,929 A 5/1905 Smith
866,965 A 9/1907 Redding
1,201,972 A 10/1916 Kelly
1,426,537 A 8/1922 Bauer
1,491,316 A 4/1924 Ryan
1,541,427 A 6/1925 Low
1,546,798 A 7/1925 Seagren
1,570,291 A 1/1926 Van Alstine
2,233,083 A 2/1941 Mackenzie
2,240,510 A 5/1941 Meighan
2,316,950 A 4/1943 Goeller
2,440,712 A 5/1948 Bickell
2,557,565 A * 6/1951 Rifkin ..... A45C 1/10 292/264
2,991,539 A 7/1961 Higgins
3,328,064 A 6/1967 Simon (Continued)

FOREIGN PATENT DOCUMENTS

AU 2010201930 A1 12/2010
CN 2234479 Y 9/1996

(Continued)

OTHER PUBLICATIONS

European Search Report issued in CC EP Application No. 10250921.3, mailed Dec. 6, 2011 pages.

*Primary Examiner* — Colleen M Chavchavadze
*Assistant Examiner* — Shiref Mekhaeil
(74) *Attorney, Agent, or Firm* — Faegre Baker Daniels LLP

(57) ABSTRACT

A wire mesh safety net for enclosing an overhead device fabricated from a wire strand formed into a bag and having a closed bottom and an open mouth with a line engaging the open mouth for opening and closing the bag around the device and having wire mesh extending and retracting structure for increasing and decreasing the extent of the wire mesh bag.

14 Claims, 15 Drawing Sheets

(56) References Cited

U.S. PATENT DOCUMENTS

| | | | | |
|---|---|---|---|---|
| 3,930,288 | A | 1/1976 | Black et al. | |
| 3,953,911 | A | 5/1976 | Fishack | |
| 4,066,144 | A | 1/1978 | Valerio et al. | |
| 4,107,825 | A | 8/1978 | Brawand | |
| 4,142,754 | A * | 3/1979 | Colvin | A01K 63/00 294/77 |
| 4,227,669 | A * | 10/1980 | McInnis | F16M 13/00 211/113 |
| 4,280,435 | A | 7/1981 | Loomis | |
| 4,520,979 | A * | 6/1985 | McInnis | F16M 13/00 248/317 |
| 4,723,634 | A | 2/1988 | Fisk | |
| 4,982,813 | A | 1/1991 | Starr | |
| 5,167,299 | A | 12/1992 | Nusbaum | |
| 5,351,367 | A | 10/1994 | Kennedy et al. | |
| 5,839,768 | A | 11/1998 | Wackerly | |
| 6,026,662 | A | 2/2000 | Schlipper | |
| 6,077,587 | A | 6/2000 | Potok | |
| 6,112,379 | A | 9/2000 | Fernandez | |
| 6,244,081 | B1 | 6/2001 | Schlipper | |
| 6,317,935 | B1 | 11/2001 | O'Rouke | |
| 6,389,655 | B2 | 5/2002 | Libecco | |
| 7,069,753 | B2 | 7/2006 | Schlipper | |
| 7,661,223 | B2 * | 2/2010 | Dudney | A01K 97/08 206/315.11 |
| 7,913,839 | B2 * | 3/2011 | Fawcett | B65D 29/04 206/315.1 |
| 8,087,270 | B1 * | 1/2012 | Gruver | A42B 3/0413 24/298 |
| 8,414,367 | B1 * | 4/2013 | Virag | E06B 7/03 160/368.1 |
| 8,714,308 | B2 | 5/2014 | Schlipper | |
| 8,998,690 | B1 * | 4/2015 | Virag | F24F 13/32 248/208 |
| 9,161,596 | B2 * | 10/2015 | Schlipper | A45C 3/001 |
| 2004/0031897 | A1 * | 2/2004 | Holland | F16M 13/00 248/317 |
| 2011/0011677 | A1 | 1/2011 | Schlipper | |
| 2014/0105522 | A1 | 4/2014 | Schlipper | |

FOREIGN PATENT DOCUMENTS

| | | | |
|---|---|---|---|
| CN | 2298302 | Y | 11/1998 |
| CN | 201050197 | Y | 4/2008 |
| CN | 101906881 | A | 12/2010 |
| DE | 20217248 | U1 | 2/2003 |
| DE | 202006015087 | U1 | 12/2006 |
| DK | 2256268 | T3 | 11/2014 |
| EP | 1162330 | A2 | 12/2001 |
| GB | 2359012 | A | 8/2001 |
| JP | H06322996 | H | 11/1994 |
| JP | H10339038 | H | 12/1998 |
| JP | 2001114334 | A | 4/2001 |
| SG | 169926 | A1 | 4/2011 |

* cited by examiner

FALL ARREST SAFETY NET

REFERENCE TO RELATED APPLICATION

This Application is a continuation in part of my application Ser. No. 12/460,245 filed Jul. 16, 2009

TECHNICAL FIELD

The present invention relates to a safety net having an attachment device for securing to a construction element particularly for use as a fall arrest apparatus.

BACKGROUND OF THE INVENTION

When working at elevated positions, in order to protect anyone below the working position, a safety apparatus should be provided to arrest a fall of debris. Typically a safety net may be suspended just below the working height fastened, for example, to free standing columns or to fixtures mounted to a wall.

However for permanent fall arrest protection, for instance in engineering facilities having overhead fittings, maintaining a suspended safety net to span the entire overhead area may not be appropriate due to the construction of the facility, the working height, the obstruction it would cause or its cost. There is therefore a need for an improved safety apparatus which addresses these drawbacks, is relatively inexpensive to manufacture and easy to install. It is an object of the present invention to address this need or, more generally, to provide an improved safety net.

DISCLOSURE OF THE INVENTION

According to one aspect of the present invention there is provided a safety net assembly comprising: a bag constructed of a wire mesh strand, the bag having an open mouth, the bag including a plurality of eyes integral with the wire mesh and spaced circumferentially about the mouth; an elongate line having a first end and a second end, a first line portion and a second line portion of the line being disposed adjacent the first end and the second end respectively, an intermediate portion of the line located between the first line portion and the second line portion, and a choker fitting having a spaced apart upper surface and lower surface through which a plurality of apertures or openings extend, and an end fixture on the choker fitting, wherein the first portion of the line is removably connected to the choker fitting, the first end of the line being removably connected to the end fixture of the choker fitting, the intermediate portion of the line extending through the eyes for drawing the mouth closed, and the second portion of the line extending through at least one of the apertures or openings in the choker fitting.

The first portion of the line provides an elongate flexible member, and while the first portion of the line may be continuous, it may alternatively be interrupted by fasteners, links, or the like, connected to adjacent ends of the line and which can be separated so that the ring may be broken as needed in some installations of the net (which are discussed below).

Preferably the intermediate portion extends through the plurality of apertures or openings in the choker fitting so that a loop in the line protrudes from each of the upper surface and lower surface of the choker fitting. It will be apparent that two apertures or openings will be sufficient for connection in this manner, however most preferably the plurality of apertures or openings include three apertures or openings through which the line passes sequentially.

Preferably the line further comprises a terminal eye formed on each of the first end and the second end of the line. The assembly preferably further comprises a spring loaded hook type fastener received in the terminal eye at each of the first end and the second end of the line, the hook type fastener on the first end of the line providing the removable connection to the end fixture of the choker fitting. The spring loaded hook type fastener on the second end of the line may be utilized for connection to any desired structure.

Preferably the upper surface and the lower surface of the choker fitting are bounded by a first pair of spaced apart side surfaces and a second pair of spaced apart side surfaces which define a region therebetween and the plurality of apertures or openings are within the region of the choker fitting. The choker fitting may be any desired geometric shape as desired for particular applications such as square, rectangular or the like. The end fixture on the choker comprises a first end fitting aperture spaced extending through the choker fitting from the upper surface to the lower surface and the end fitting is spaced from the plurality of apertures The hook type fastener on the first end of the line is removably connectable to the first end fitting aperture. Thus, by pulling on one or both of the loops, the circumference of the mouth is decreased to allow a desired fitting configuration.

Preferably the wire mesh bag is formed from a length of wire strand with fastenings joining portions of the length of wire strand, the length of wire extending from the closed end toward the mouth and being turned back upon itself to form the eyes at the mouth and corresponding eyes at the closed end, each eye at the mouth being fixed by a respective one of said fastenings to the adjacent eye on either side thereof, and each eye at the closed end being fixed by a respective one of said fastenings to the adjacent eye on either side thereof to form the bag.

The fastenings that join two portions of the length of wire and are preferably all of like type, most preferably being ferrules which are crimped or molded in place.

Preferably the fastenings joining the eyes at the closed end are more closely spaced along the length of wire than the fastenings joining the eyes at the mouth.

In another aspect the invention provides a method of securing apparatus mounted overhead upon a construction member, the method comprising:

providing a safety net assembly substantially as described above; introducing the apparatus through the mouth so as to at least partially enclose the apparatus in the wire mesh bag; manipulating the choker fitting and line to close the mouth; looping the second portion about the construction member, and connecting the first portion and the second end by means of a hook fastener.

The thickness or gauge of the wire mesh strand may be on the order of 0.5 to 1.0 millimeters and the thickness or gauge of the line may be on the order of 1.5 to 2.00 millimeters The present invention also may also include one or more wire mesh extent adjustments. Each of the wire mesh adjustments comprise a short length of auxiliary wire having a first end and a second end and the first end and the second end are secured to the wire mesh strand at, for example, a first section thereof thereby leaving a wire mesh strand accepting space between the auxiliary wire and the wire mesh strand. A second section of the wire mesh strand is passed through the wire mesh strand accepting space and a toggle is coupled to the second section of the wire mesh strand. The toggle is sized so as to prevent the second section from exiting the wire mesh strand accepting space. Thus, the extent of the wire mesh may be reduced by pulling on the second section of the wire mesh strand so that more of the second section extends through the wire mesh strand accepting space thereby reducing the extent of the wire mesh. The auxiliary wire may be the same thickness or gauge as the wire mesh strand and the length thereof may be on the order of five to ten centimeter though heavier or lighter gauges and longer or shorter lengths of the auxiliary wire may be utilized as desired for particular applications.

The present invention may also include a pair of spaced apart locator tabs. Each of the locator tabs comprises a disc coupled to the wire mesh strand preferably at opposite locations thereon. The locator discs provide a visual indication of the extent of the wire mash bag thereby allowing for proper installation of the wire mesh bag.

Thus, this invention provides a safety net assembly which is effective and efficient in operational use, and which has an overall simple design which minimizes manufacturing costs and maximizes performance.

BRIEF DESCRIPTION OF THE DRAWINGS

Preferred forms of the present invention will now be described by way of example with reference to the accompanying drawings, wherein similar reference characters refer to similar elements and in which:

FIG. 1 is formed;

DESCRIPTION OF THE PREFERRED EMBODIMENTS

Figure 1:
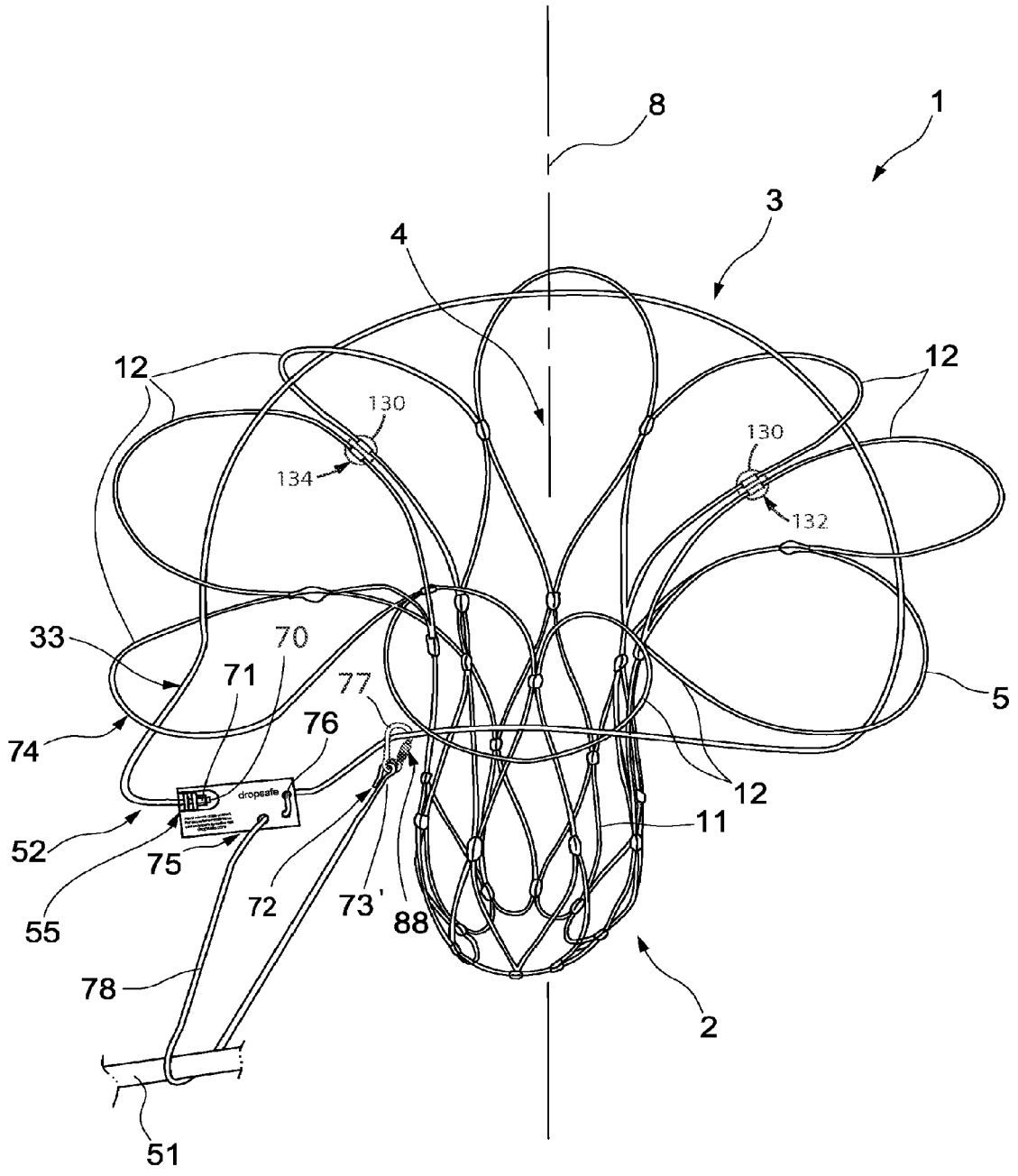
FIG. 1 is pictorial view of a first exemplary embodiment of the safety net assembly of the invention in a collapsed state ready to receive an item of value.
Figure 2:
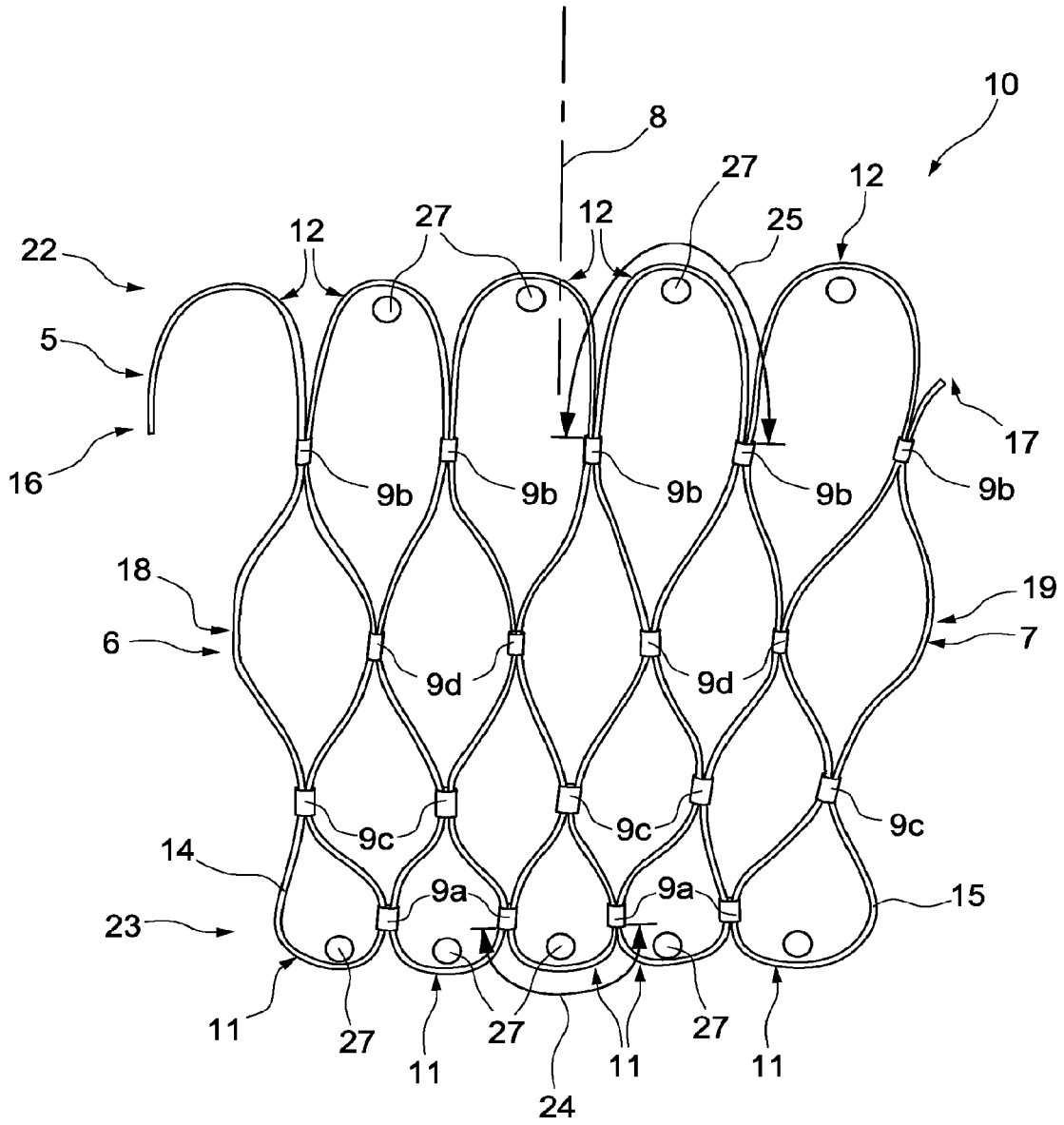
FIG. 2 is a plan view of a web of mesh from which the safety net assembly

Referring to FIGS. 1 and 2 of the drawing, a first embodiment of a safety net assembly includes a wire mesh bag 1 comprised of a wire mesh strand having a narrow closed end 2 and a broader opposing open mouth 3 in which an opening 4 is provided for receiving an apparatus to be secured, such as a light fitting 50 (shown in FIG. 7) mounted overhead on a construction member such as a beam 51. A line 33 passes in a ring through the eyes 12 of the mouth 3 and cooperates with a choker fitting 52 to draw together the eyes 12 to close the opening 4. A second end of the line 33 is secured to a structure such as the beam 51 to secure the assembly in place.

In the first embodiment illustrated the mesh is made from a length of wire strand 5 which may be continuous (i.e. a single length) or discontinuous (for instance, including end-to-end joints) and which provides a degree of flexibility and resilience to the bag 1, allowing it to be expanded in the transverse direction to accommodate apparatus of varying size, while being readily collapsible. The bag 1 is made from a planar mesh 10, shown in FIG. 2, which is curved or folded about a longitudinal axis 8; the transversely opposing edges 6, 7 of the mesh 10 are then joined to produce the substantially tapered bag-like form (shown in FIG. 1 in its collapsed or relaxed state).

The wire mesh 10 is a non-woven strand type in which portions of the length of wire 5 are joined by fastenings in the form of ferrules 9*a*, 9*b*, 9*c*, 9*d* at nodes of the mesh. The length of wire 5 extends generally longitudinally and is turned back upon itself and joined by ferrules 9*c* to form eyes 11 at the first edge 23 of the mesh 10, and by ferrules 9*d* to form eyes 12 at the longitudinally opposing second edge 22 of the mesh 10. Fastenings in the form of ferrules 9*b* join the adjacent eyes 12 along the second edge 22 and ferrules 9*a* join the adjacent eyes 11 along the along the first edge 23.

Figure 3:
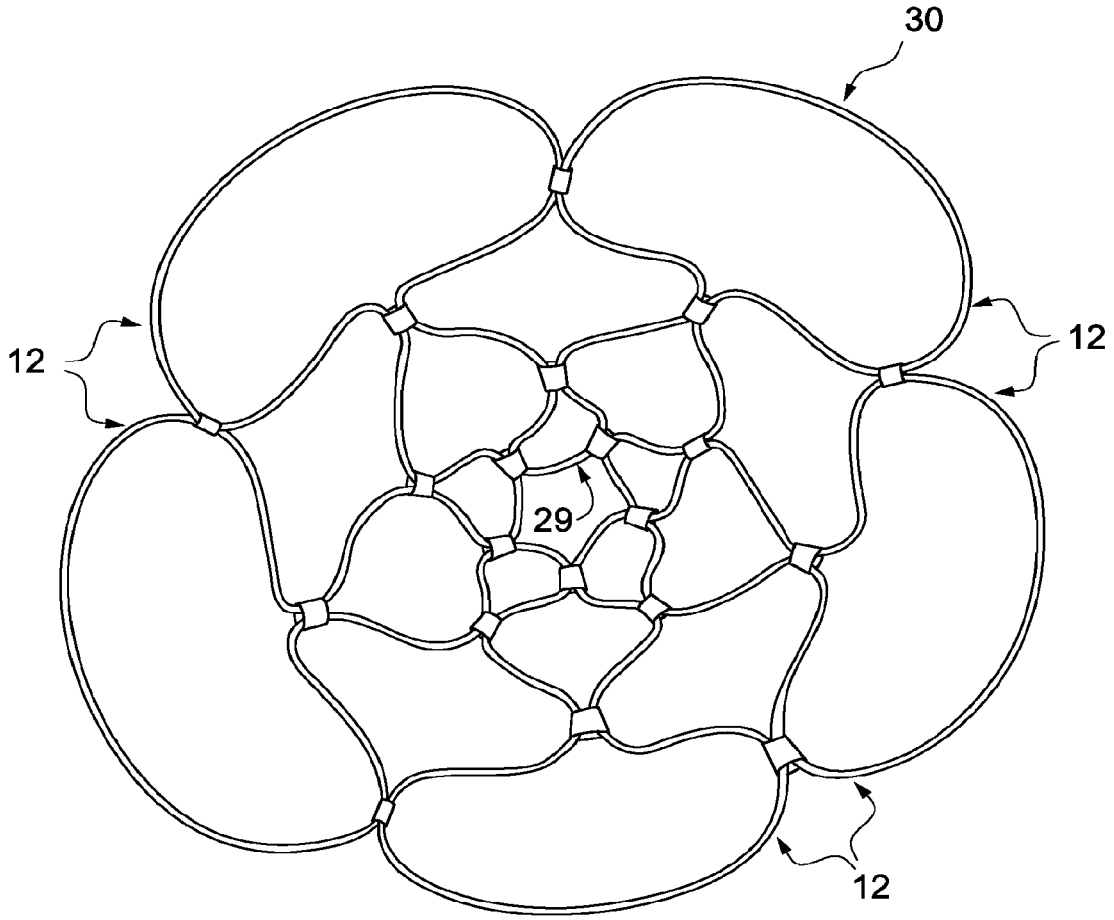
FIG. 3 is a plan view of the safety net assembly of FIG. 1.

The mesh 10 may be conveniently manufactured by winding the length of wire 5 between pegs 27 spaced apart in two parallel lines, the lines being spaced apart in the longitudinal direction (relative to the mesh 10). The length of wire 5 is wound about the pegs in a zigzag pattern, alternating in direction when it is turned back upon itself around each peg 27. To then form the bag 1 from the mesh 10 of FIG. 2, the mesh 10 is removed from the pegs 27 curved about the longitudinal axis 8. Portions 14 and 15 of the outermost first edge eyes 11 are then joined by a ferrule (not shown) such that each eye 11 is fixed by a ferrule to the adjacent eye on either side thereof. In like manner the ends 16, 17 of the length of wire 5 are joined by a ferrule (not shown) such that each eye 12 along the second edge 22 is fixed by a ferrule to the adjacent eye on either side thereof. In addition a further ferrule (not shown) joins portions 18 and 19 on opposing transverse edges of the mesh 10 to form the substantially axisymetrical bag 1. As best seen in FIG. 3, all the eyes 11 are joined in a first ring 29 to form a closed end of the bag 1. All the eyes 12 are joined in a second ring 30 which forms the opening 4.

To produce a bag 1 shaped to taper outwardly from the closed end 2 toward the open mouth 3, the transverse dimension of the second edge 22 exceeds that of the first edge 23. To achieve this, the eyes 12 are larger than the eyes 11 and the ferrules 9*a* joining the eyes 11 are spaced more closely apart (by dimension 24 measured along the length of wire 5) than the ferrules 9*b* joining the eyes 12 on the second edge 22 (which are spaced by dimension 25 measured along the length of wire 5).

Figure 4:
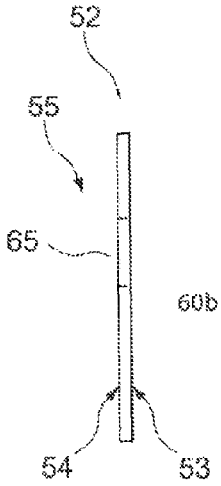
FIGS. 4, 5 and 6 are orthogonal end, front and side views respectively of the choker fitting of the safety net assembly of FIG. 1.
Figure 5:
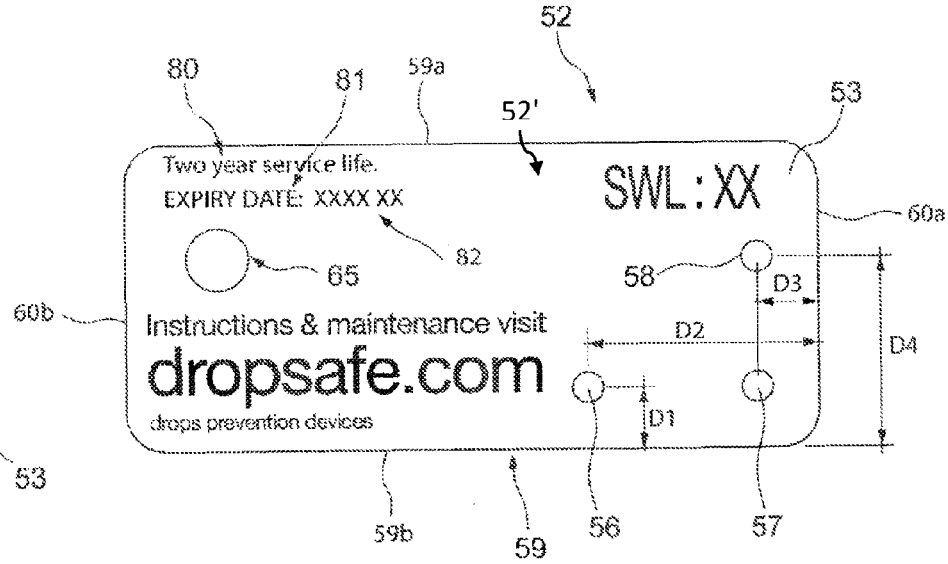
Figure 6:
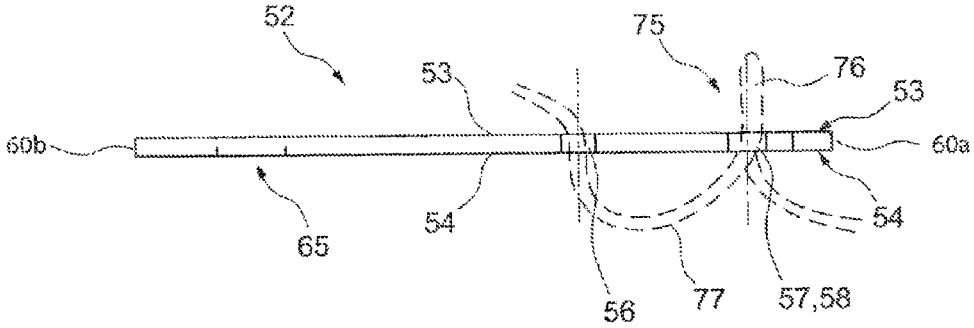

The choker fitting 52 shown in detail in FIGS. 4-6, is formed from a substantially rectangular stainless steel sheet having an upper surface 53 and a lower surface 54. On one side of the choker fitting 52 is an end fixture 55, while on the opposite side are three circular apertures or openings 56, 57, 58 extending through the choker fitting 52 from the upper surface 53 to the lower surface 54. The choker fitting 52 is bounded by a first pair of spaced apart edge surfaces 59*a* and 59*b* and a second pair of edge surfaces 60*a* and 60*b* which define a choker fitting region 52' therebetween. The apertures or openings 56, 57 and 58 are sized to receive the line 33. A first line end fixture 55 is provided on the choker fitting 52 and the first line end fixture 55 in the preferred embodiment is first line end receiving aperture 65 extending through the choker fitting 52 from the upper surface 53 to the lower surface 54 and the first line receiving aperture is spaced from the apertures 56, 57 and 58.

If desired, on the front face 53 are textual indicia 80 including an "Expiry date" marking 81 located adjacent a blank area 82 where a date can be permanently marked, by engraving, etching, stamping of the like, to notify users of the end of the working life of the product.

The line 33 has a first end 70 which is removably connected to the choker fitting 52 by a first end hook fastener 70' mounted on a terminal eye 73 and the hook fastener 70' is coupled to the line receiving aperture 65. A second end 72 of the line 33 opposite the first end 70 includes a terminal eye 73' similar to the terminal eye 73 and a second end hook fastener 70" connected to the terminal eye 73'. The first end hook fastener 70' and the second end hook fastener 70" may D ring type fasteners as shown on FIGS. 7 and 8 or may be carabineer type fasteners as shown on FIGS. 21 and 22 though other types of fasteners suitable for the purpose may be utilized in particular applications as desired.

A first portion 74 of the line 33 adjacent the first end 70 extends from the end fixture 55 in a ring through the eyes 12 for drawing the mouth 3 closed. A second portion 78 of the line 33 extends from the choker fitting 52 to the second end 72.An intermediate portion 75 of the line 33 is located between the first line portion 74 and second line portion 78, and passes sequentially through the openings 56, 57, 58 in the choker fitting. As shown in dashed outline in FIG. 6, a first loop 76 of the line extends through the openings 57, 58 to protrude from of the upper surface 53, while a second loop 77 extending between openings 56 and 57 protrudes from the lower surface 54.

The line 33 and the length of the wire strand of the mesh bag 1 are preferably twisted stainless steel wire cables for corrosion resistance. The wire mesh may be formed of wire strand having a gage or thickness in the range of 0.5 millimeters to 1.0 millimeters and wire 33 may be formed of a wire having a gage or thickness of 1.5 millimeters to 2.0 millimeters though larger or smaller gauges may be selected for the wire mesh strand and the wire 33 as desired for particular applications. The other components, such as the ferrules 9*a*, 9*b*, 9*c*, 9*d* and the hook fasteners 70' and 70" are also formed of stainless steel.

Figure 7:
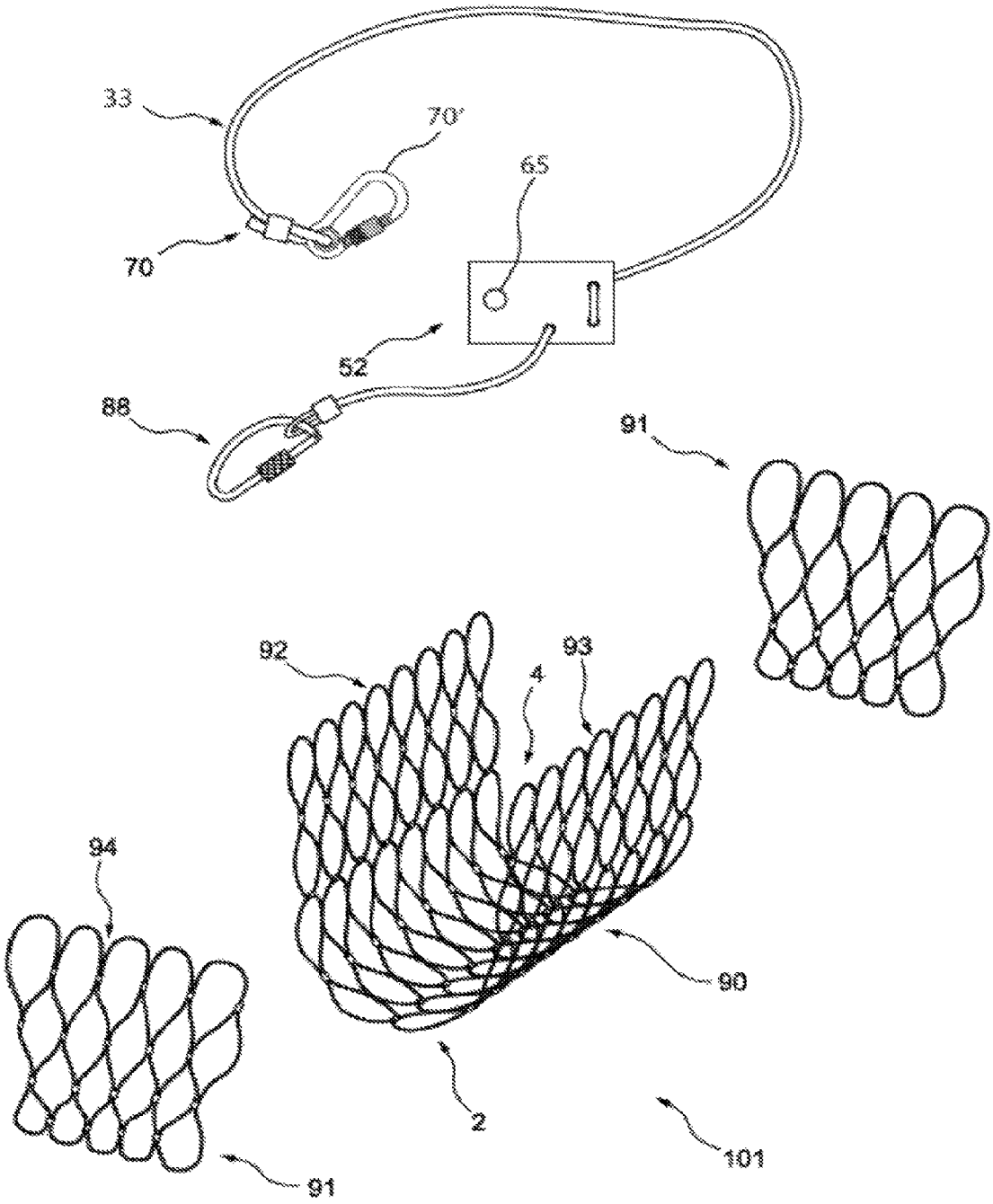
FIG. 7 is an exploded pictorial view of a second exemplary embodiment of the safety net assembly of the invention.

FIG. 7 shows an exploded view of a second embodiment of the safety net assembly employing the line 33 and choker 52 of the first embodiment, but wherein the bag 101 is assembled from a folded main panel 90 and two like end panels 91. The panels 90, 91 are each formed of a flexible wire mesh, and may each be formed initially as a planar mesh from a single length of wire joined at nodes of the mesh by ferrules, or molded beads etc. The main panel 90 is a rectangular panel folded in a curve and includes rows of eyes 92, 93 along longitudinally opposite transverse edges which, when the panel 90 is folded in a curve as shown are brought together to form opposing sides of the mouth 4, the curved central section of panel 90 forming the closed end 2. The panels 91 have a row of eyes 94 along one edge and are shaped with an arcuate opposing edge complementary to the form of the panel 90. Each end panels 90 is fixed about its peripheral edge, as by ferules or the like, to a long edge of the panel 91, such that the rows of eyes 92, 93, 94 are generally coplanar, the eyes being spaced about the periphery of the mouth 4. In like manner to the first embodiment, the line 33 passes from the choker fitting 52 through the eyes 92, 93, 94 and back to the choker fitting 52, for drawing the mouth 3 of the bag 101 closed.

Figure 8:
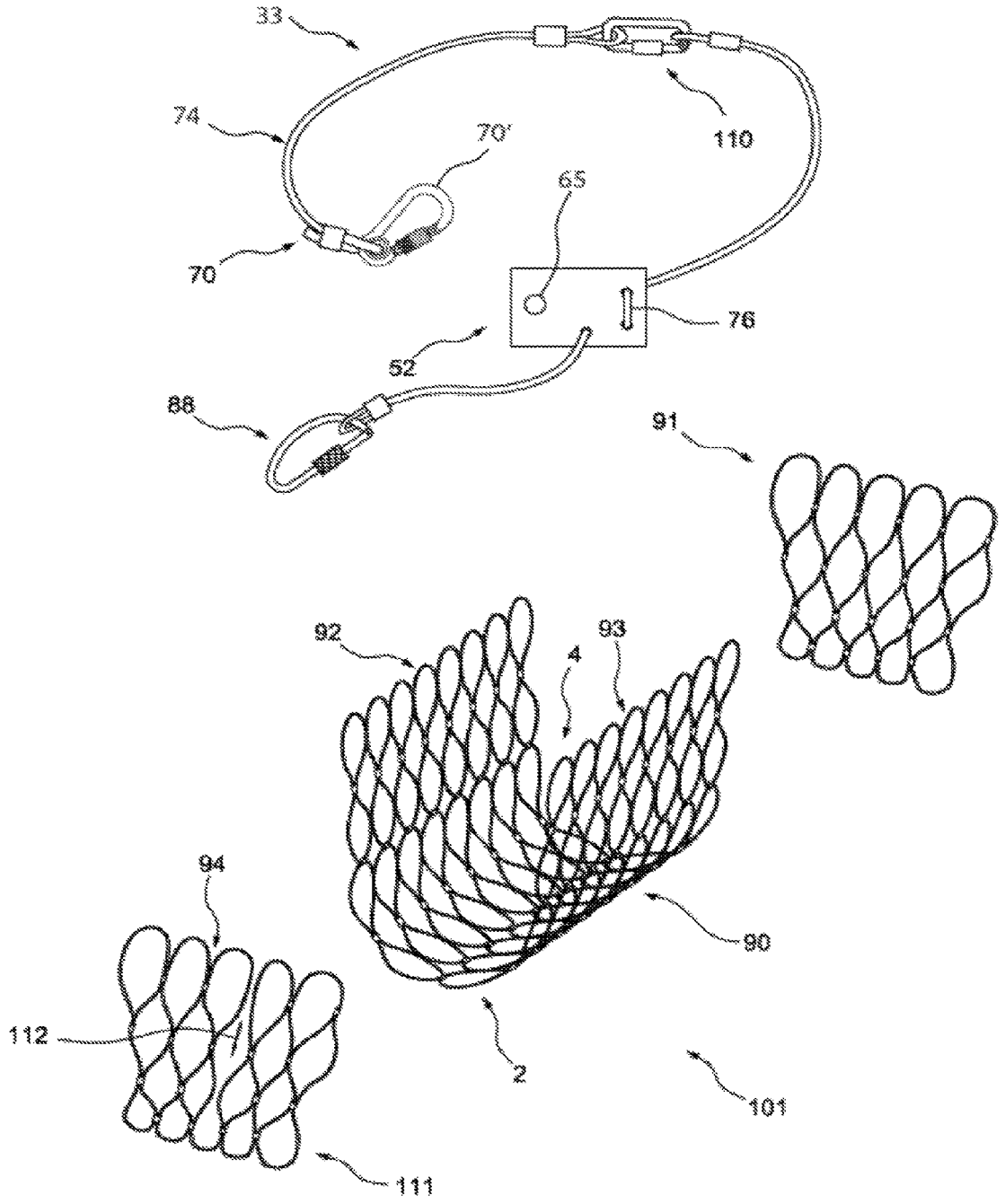
FIG. 8 is an exploded pictorial view of a third exemplary embodiment of the safety net assembly of the invention.

A third embodiment of the invention is shown in FIG. 8 and includes panels 90, 91, 111 each formed from a flexible wire mesh. The panels 111, like the panels 91 the second embodiment, have a row of eyes 94 along one edge and are shaped with an arcuate opposing edge complementary to the form of the panel 90. The panel 111 further includes a slit 112 in the fabric of the mesh (where adjacent wire loops are disconnected). The slit 112 extends longitudinally down from the row of eyes 94 to an intermediate position in the panel. The end panel 111 is otherwise of like construction to the panels 91 and is fixed about its peripheral edge to a long edge of the panel 91, in like manner to the second embodiment. The ring-shaped first portion 74 has a fastener 110 connected in the line 33, allowing the ring to be opened and closed. As shown, the fastener 110 may be a carabineer joining permanent eyes formed in the first portion.

Figure 21:
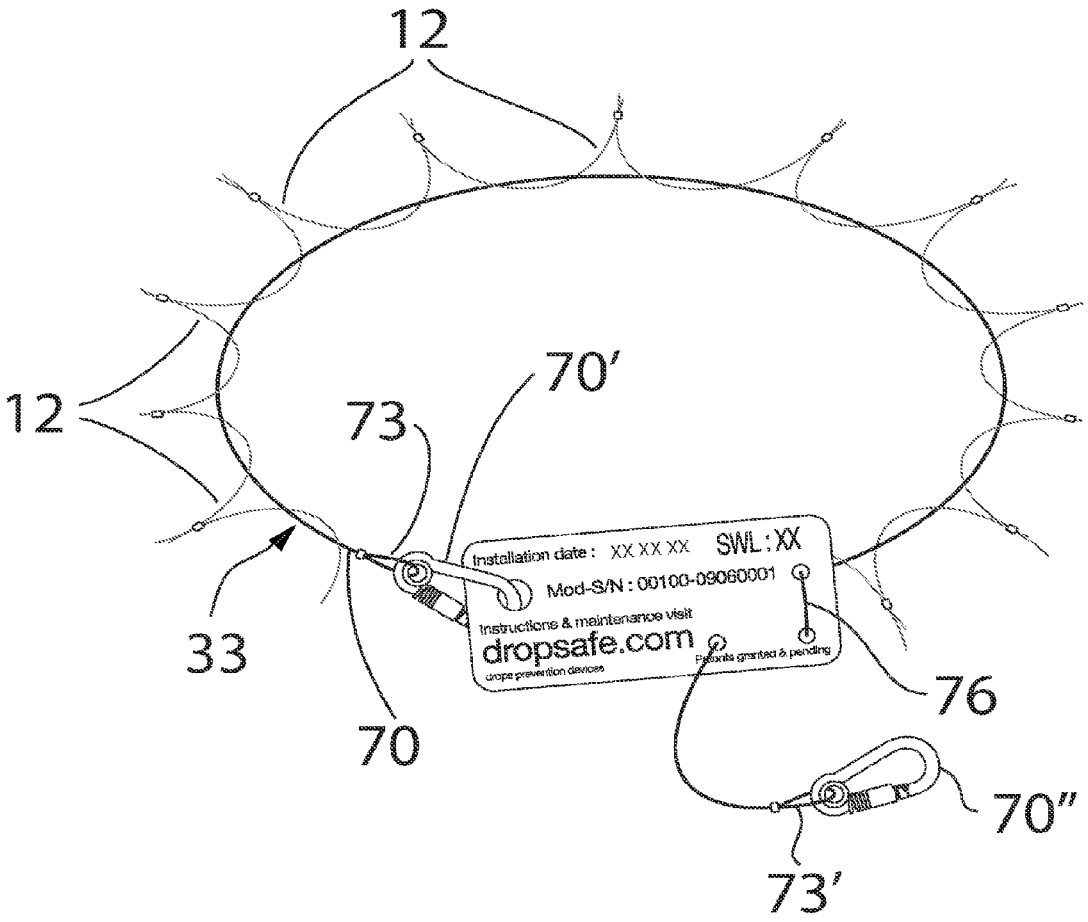
FIGS. 21 and 22 illustrates a choker fitting connection useful in the practice of the present invention; and, FIGS. 23, 24 and 25 illustrate various applications of the present invention.
Figure 22:
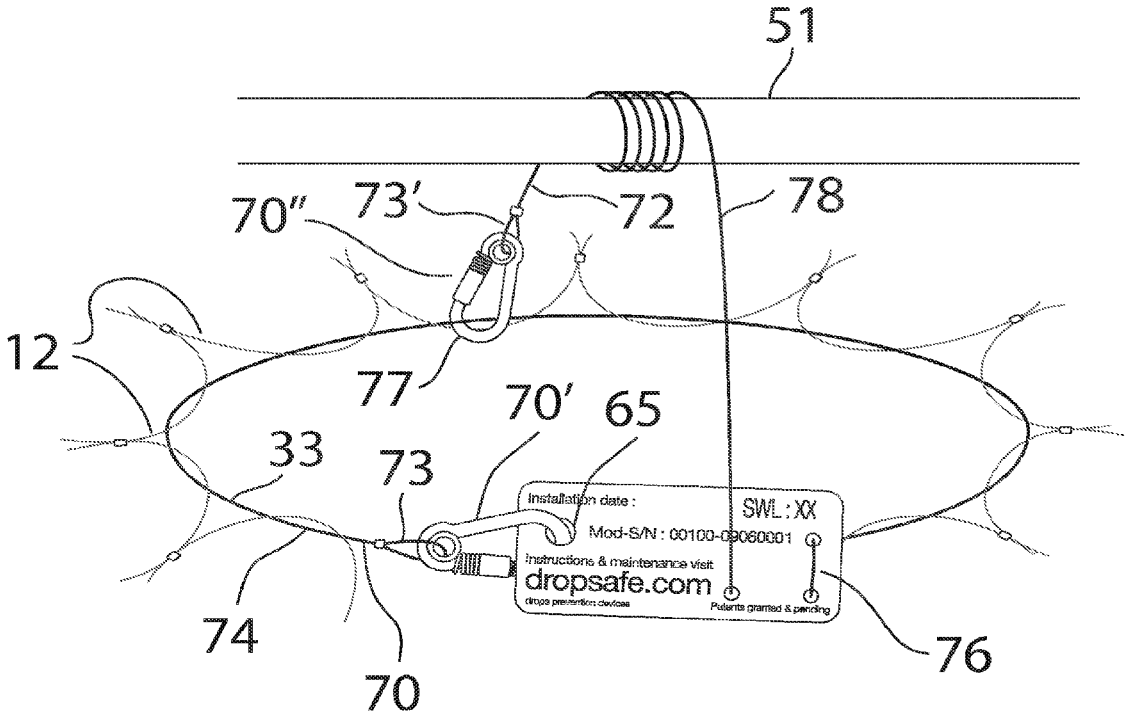

In FIGS. 7 and 8, the first end hook fastener 70' is shown disconnected from the aperture 65 in the choke 52 for clarity and is shown connected to the aperture 65 in choke 52 in FIGS. 21 and 22. In FIG. 22, the intermediate portion 78 of the wire 33 is shown wrapped and around the beam 51 and the second end hook fastener such as the carabineer 70" is connected to the wire 33 as indicated at 77 in FIG. 22, and in FIG. 1

Figure 9:
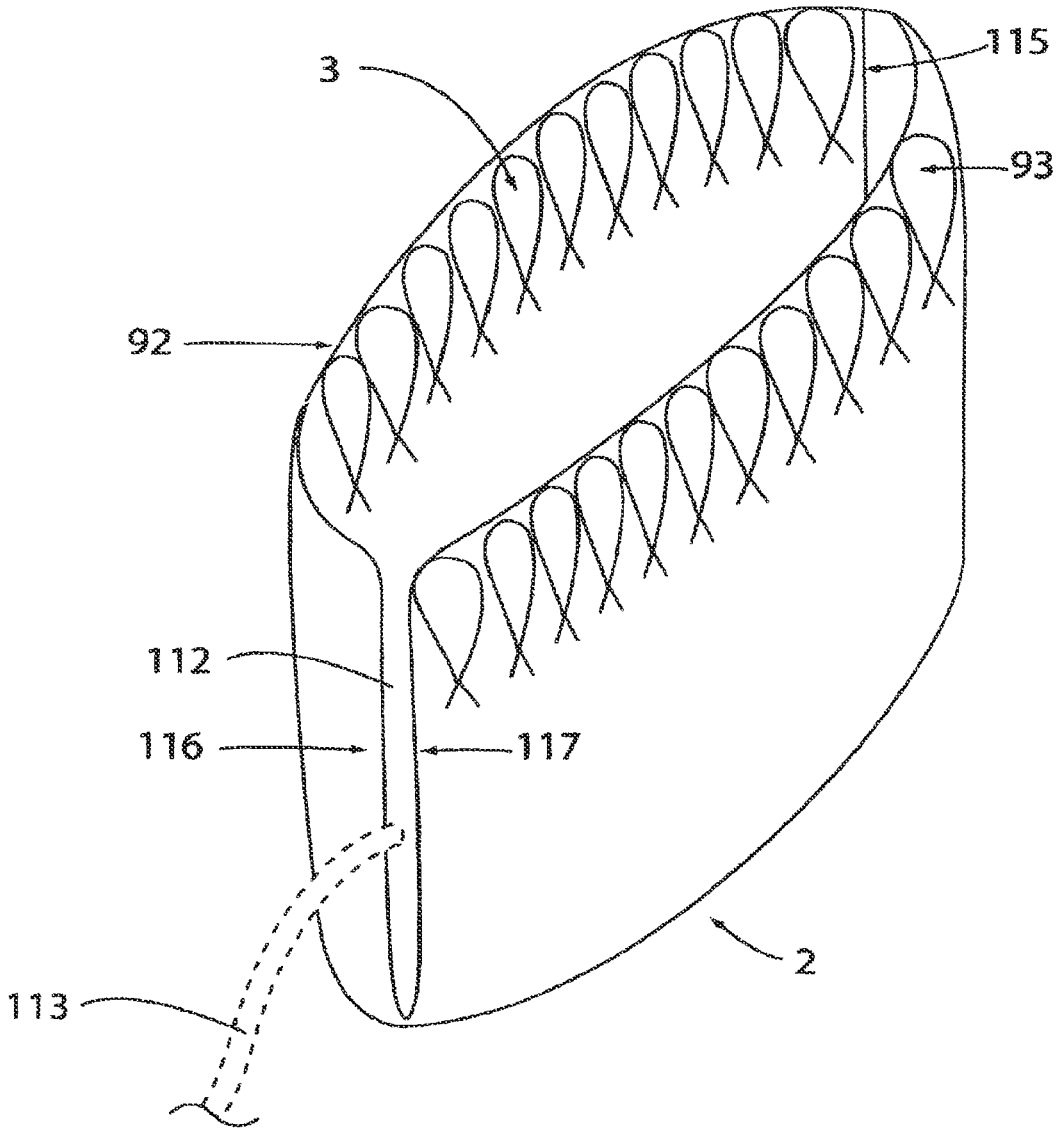
FIG. 9 is schematic pictorial view of a fourth exemplary embodiment of the safety net of the invention.

In a fourth embodiment the net of the invention, shown in FIG. 9, is formed from a single generally rectangular panel of flexible wire mesh. Like the second and third embodiments, a folded central part of the panel forms the closed end 2 and the opposing short edges of the panel bound the periphery of the open mouth 3, the line 33 passing from the choker fitting 52 through the eyes 92, 93 and back to the choker fitting 52, for drawing the mouth 3 closed. The two halves of the long edge on one side of the panel are connected by joining line 115. The two halves 116,117 of the opposing long edge of the panel are not joined, and define a slit 112 extending from the mouth 3 down one side of the bag toward the closed end 2, in like manner to the third embodiment of FIG. 8.

Figure 10:
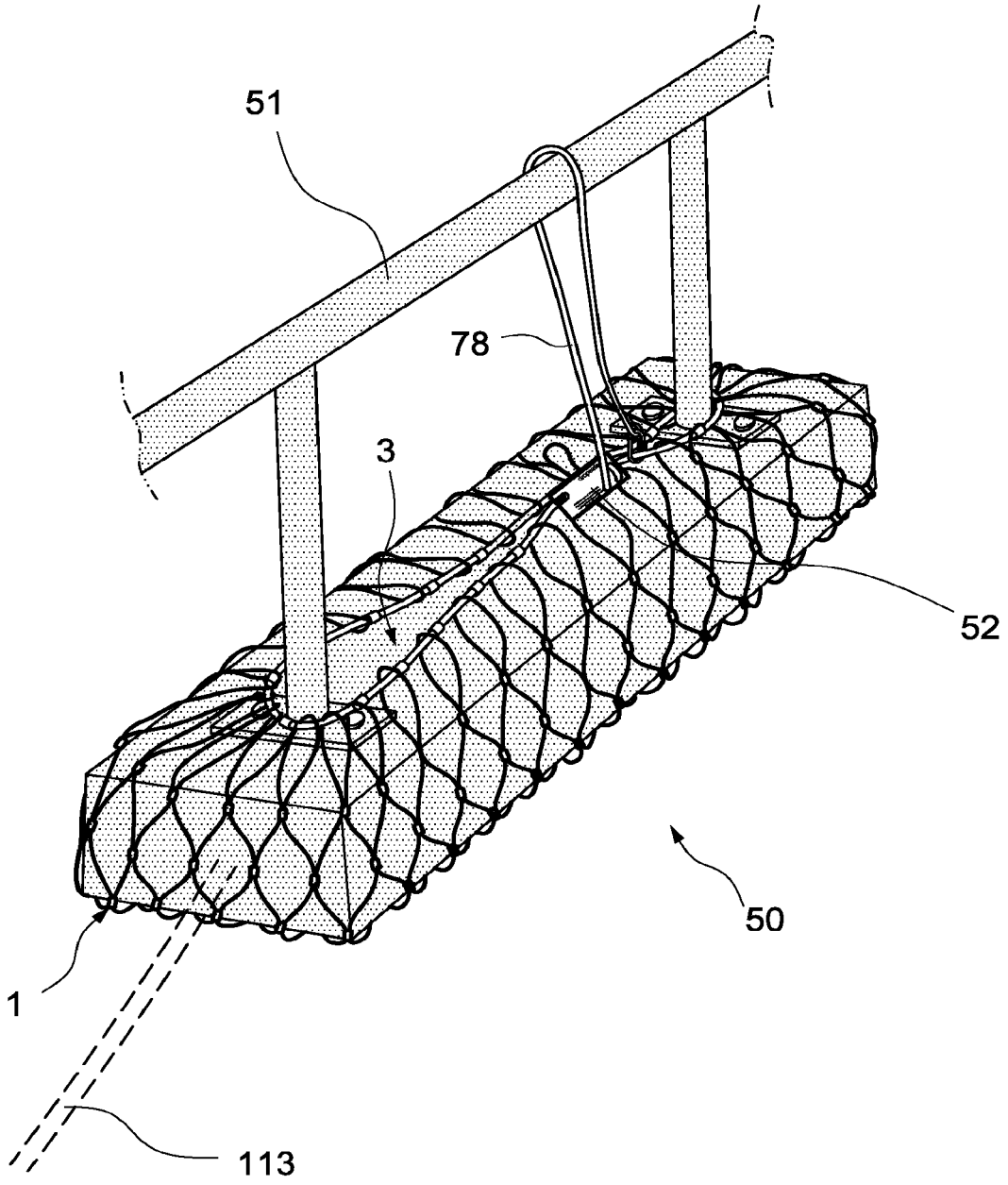
FIG. 10 is a perspective view of an alternative embodiment of the safety net assembly of the invention installed in use.

In use, as best seen in FIG. 10, the components of the light fitting 50 are first introduced through the open mouth 3 thereby substantially enclosing the light fitting in the bag 1. By then manipulating the choker fitting to draw the line through the openings 56, 57, 58 the ring-shaped first line portion 74 is reduced in size to close the mouth 3. The second portion 78 of the line 33 is then looped about the construction member 51. A hook fastener 88 (such as a carabineer having a hinged gate and screw closure) is inserted through the terminal eye 73' and through the ring-shaped first line portion 74 to secure the assembly. When the third embodiment is used a member 113 (such as the power cable shown in phantom in FIGS. 9 and 10) which protrudes through the bag may be received in the slit 112, while still closing the mouth 3. The fastener 110 is positioned proximate the slit 112 and opened to break open the ring and allow entry of the member 113 into the slit 112. By reconnecting the fastener 110, the mouth can then be drawn closed, to the same degree as the second embodiment, substantially enclosing the light fitting 50.

Figure 17:
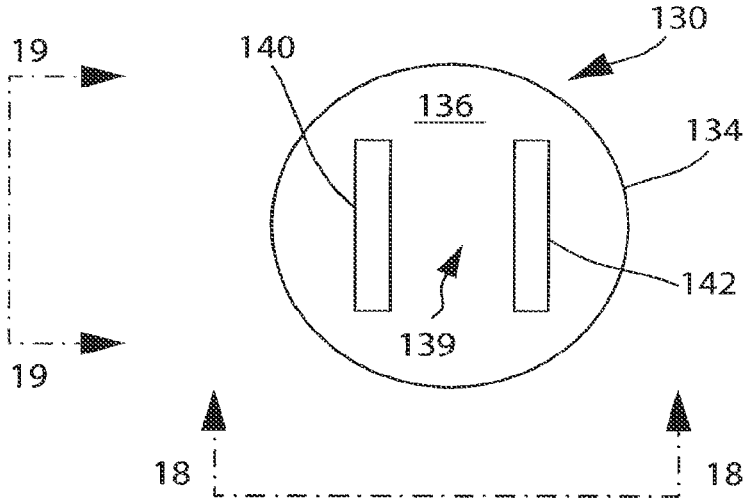
FIGS. 17, 18, 19 and 20 illustrate a locator disc useful in the practice of the present invention.
Figure 18:
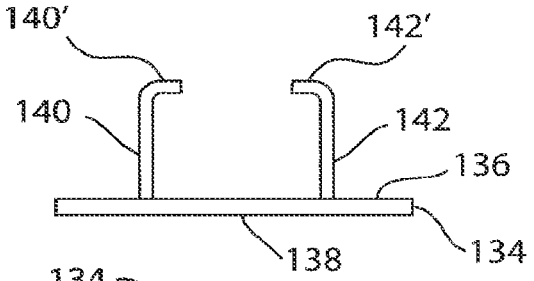
Figure 19:
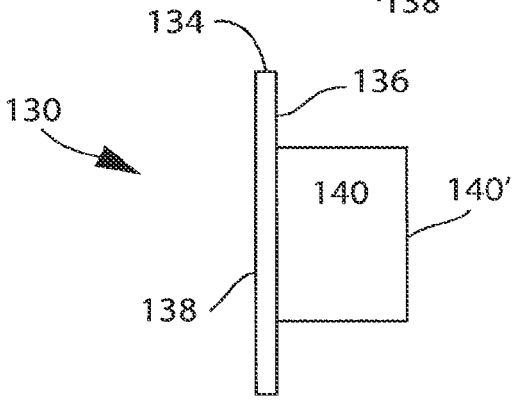
Figure 20:
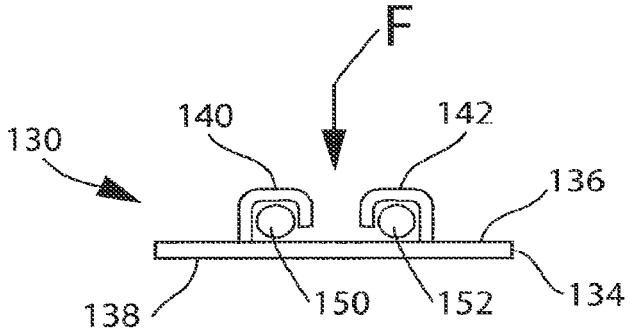

In some applications of the present invention it may be desirable to provide indicator tabs on the wire mesh. One or more such indicator tabs may be incorporated in each of the embodiments of the present invention described herein or any other variation of the structure of the present invention as desired for particular applications. Two such locator tabs 130 are shown on FIG. 1 at locations indicated at 132 and 134 which are, preferably 180° apart and are applied to the wire mesh bag 1 where two nodes of the wire mesh bag are adjacent to each other and may be utilized thereat in place of the ferules such as ferules 9*a*, 9*b*, 9*c* and/or 9*d*. so as to indicate the extent of the wire mesh bag 1 to allow for careful installation thereof. FIGS. 17, 18 and 19 illustrate the structural details of the locator disc 130 and FIG. 20 illustrates the assembly of the locator tab 130 on two adjacent nodes 150 and 152 of the wire mesh strand. As shown thereon, each locator tab 130 has a generally circular, disc like body member 134 though other geometric shapes may be provided for particular applications. A clamping member 139 is comprised of a pair of legs 140 and 142 which are coupled to the upper surface 136 of the body member 134. Each of the legs 140 and 142 have a curved upper end 140' and 142'. After installation on the adjacent nodes of the wire strands of the bag 1, a force indicated by the narrow F is applied to the legs 140 and 142 bending them down towards the upper surface 136 of the disc like body member 134 to clamp the adjacent nodes 150 and 152 of the wire mesh strand of the bag 1 to the upper surface 136.

Figure 11:
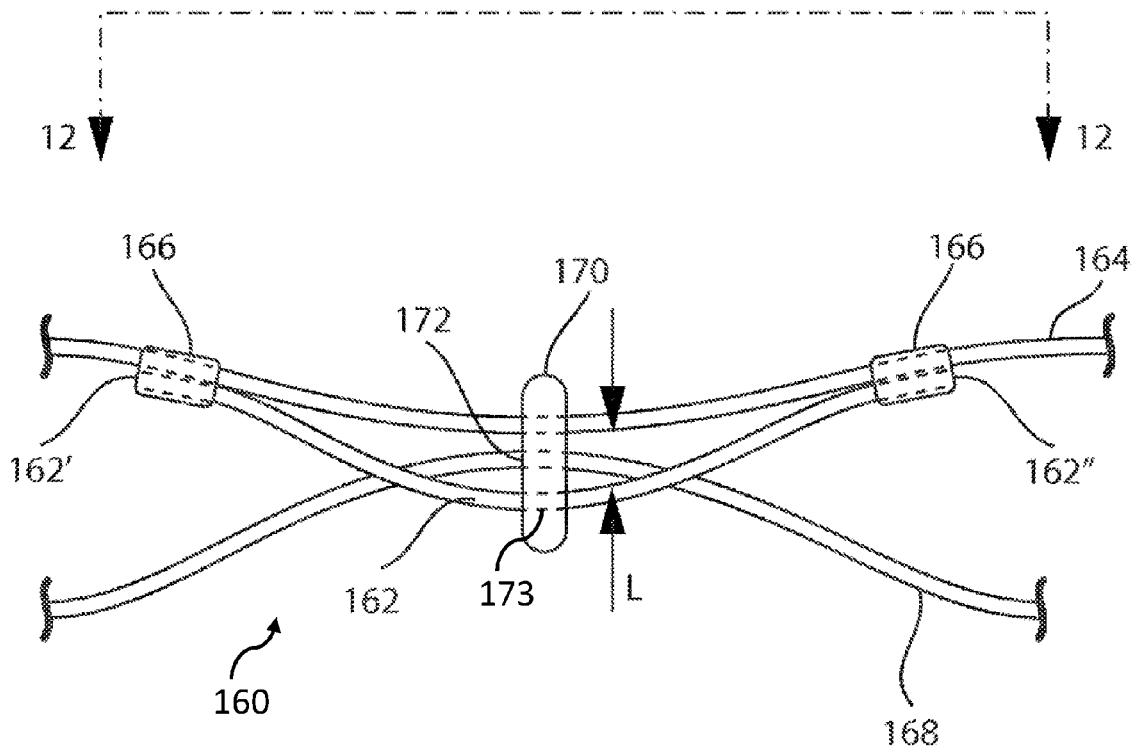
FIGS. 11, 12 and 13 illustrate the structure for forming a wire mesh extent adjustment.
Figure 12:
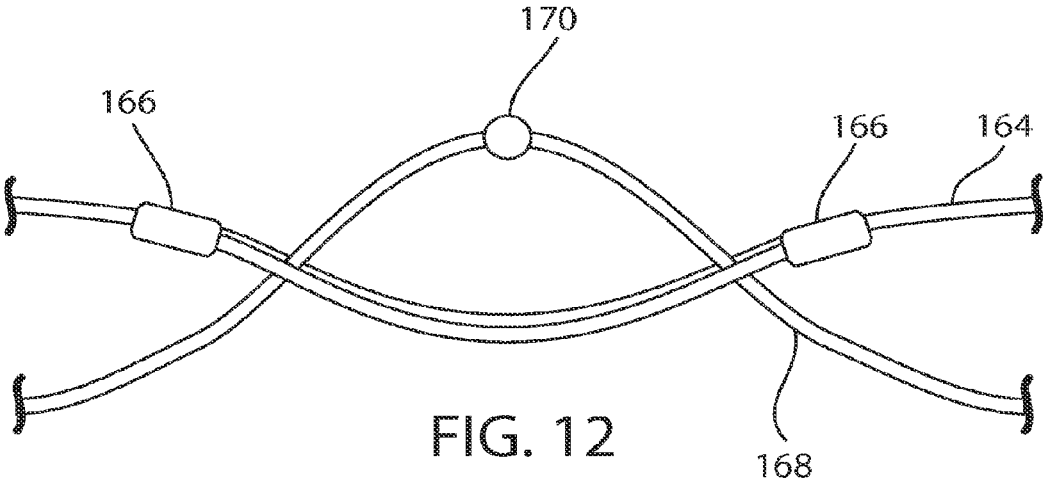
Figure 13:
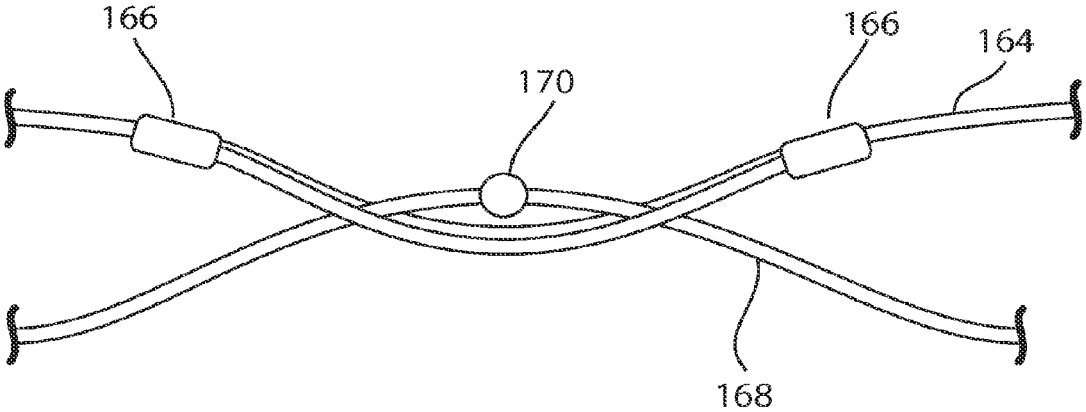

The present invention may also include structure for increasing or decreasing the size of the bag 1 in order to accommodate various sized apparatus such as the light fitting 50 (FIG. 10) to provide a close or loose fit with respect thereto. FIGS. 11, 12 and 13 illustrate a preferred form of the structure 160 for varying the extent of the wire mesh bag 1 and may be installed, for example, in place of one or more of the ferules 9*d* between ferules 9*c* and 9*b* shown on FIG. 2 and may be incorporated in any of the embodiments described herein. As shown in FIGS. 11, 12 and 13 a short length of an auxiliary wire 162 having a first end 162' and a second end 162". The auxiliary 162' is coupled at the first end 162' and second end 162" to a first strand section 164 of the wire mesh of bag 1 by, for example, tape indicated at 166 to define a wire mesh strand accepting space opening indicated a L therebetween. A second strand section 168 of the wire mesh of bag 1 which is adjacent the first strands section 164 is pulled through the opening L. A toggle 170 is fixed to the second strand section 168 as indicated at 173 to lie over and across the opening L and is sized to prevent the toggle 170 from being pulled through the opening L. FIG. 12 shows the second strand section pulled through the space L a desired amount and any amount of the wire strand of the mesh may be so pulled through thereby decreasing the extent of the bag 1. FIG. 13 shows the structure 160 where the second strand 168 is pulled down so the toggle 170 is bearing against the auxiliary wire 162 and the first strand section 164 across the opening L to provide the maximum extent to the bag 1.

Figure 14:
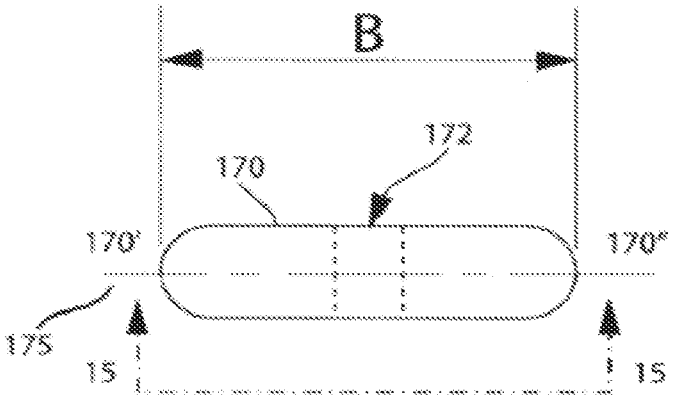
FIGS. 14, 15 and 16 illustrate a toggle useful in the practice of the present invention.
Figure 15:
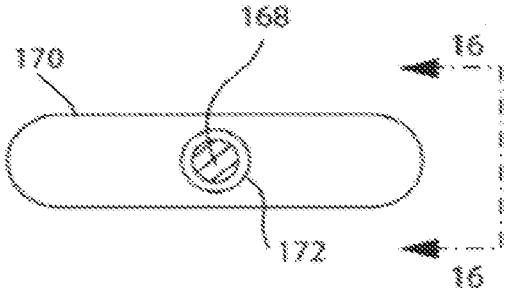
Figure 16:
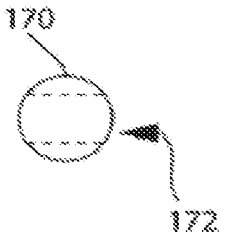

FIGS. 14, 15 16 illustrate the toggle 170 of the structure 160. The toggle 170 is a generally solid cylinder having an axis 175 and an axial length B with rounded ends 170' and 170". A wire strand accepting aperture 172 is provided to extend through the toggle 170 and the second strand 168 is positioned in the aperture 172 and is fixed, for example by crimping to provide a permanent attachment therebetween. As noted above, the axial length B is selected so that the toggle 170 cannot fit through the opening L.

Figure 23:
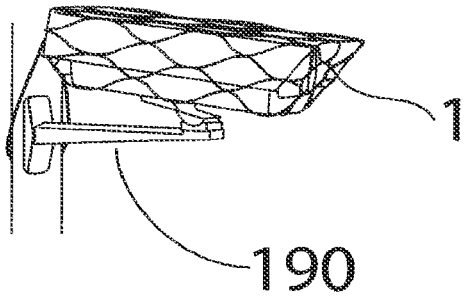
Figure 24:
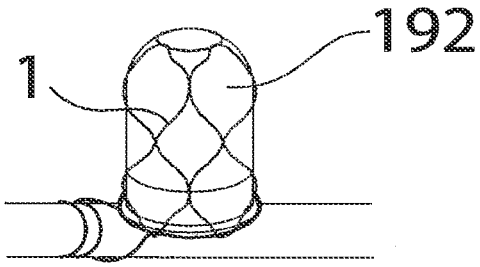
Figure 25:
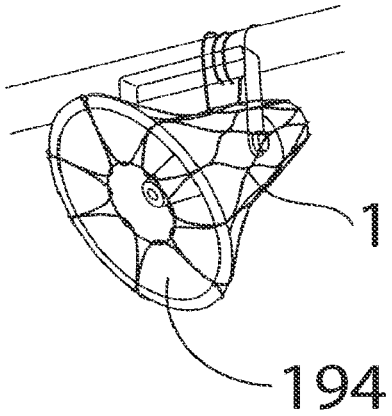

The mesh bag of the present invention is adaptable to accommodate a wide variety of fixtures other than the generally rectangular prism shape of the electrical fitting 50 shown in FIG. 10. FIGS. 23, 24 and 25 illustrate a few of the shapes of fixtures that may be safely enclosed by the mesh bag of the present invention. FIG. 23 shows the bag 1 enclosing a closed circuit TV camera 190. FIG. 24 shows the bag 1 enclosing a navigation/strobe warning light 192 and FIG. 25 shows the bag 1 enclosing a speaker/horn 194.

While particular embodiments and applications of the present invention have been above described and illustrated, the present invention is not limited to the precise construction and arrangements disclosed. Those persons knowledgeable in the art may conceive of certain modifications, changes and variations in the detailed embodiments disclosed above as illustrative, to suit particular circumstances or products to be formed. The invention is therefore not intended to be limited to the preferred embodiments depicted, but only by the scope of the appended claims and the reasonably equivalent apparatus and methods to those defined therein

The invention claimed is:

1. A fall arrest safety net arrangement for securing an overhead fitting device, the fall arrest safety net arrangement comprising:

a wire mesh bag having an open mouth and a closed end, the wire mesh bag constructed of wire strand having a first thickness and formed by joining adjacent portions of the wire strand and forming a plurality of eyes spaced circumferentially about the mouth;

a slit in the wire mesh bag extending from the open mouth toward the closed end, the slit separating a first length of the wire strand and a second length of the wire strand from one another, the second length of wire strand adjacent to the first length of the wire strand;

an elongate line having a second thickness greater than the first thickness of the wire strand, and having:

a first end, a second end spaced apart from the first end, and an intermediate portion located between the first end and the second end and extending through the eyes spaced circumferentially about the mouth;

a choker fitting having:

an upper surface, a lower surface, a plurality of line accepting apertures extending between the upper surface and the lower surface of the choker fitting, and an end fixture having a first end accepting aperture extending between the upper surface and the lower surface of the choker fitting and spaced from the plurality of line accepting apertures, wherein the elongate line extends through at least one of the line accepting apertures; and at least one wire mesh extent adjustment comprising an auxiliary wire having a first end and a second end secured to a first section of the wire strand to define a mesh strand accepting space opening between the auxiliary wire and the first section of the wire strand, and a toggle on a second section of the wire strand, sized to selectively prevent a portion of the second section of the wire strand from exiting the mesh strand accepting space opening.

2. The fall arrest safety net arrangement of claim 1 and further comprising:

a pair of locator tabs mounted on the wire strand in spaced apart relationship, each of the locator tabs comprising:

a body member having a first side and a second side opposite the first side; and a clamping member coupled to the first side of the body member, the clamping member having a pair of legs, one of the legs clamping a first portion of the wire strand to the first side of the body member and the other leg clamping a second portion of the wire strand to the first side of the body member.

3. The fall arrest safety net arrangement of claim 1 and further comprising:

a first hook member coupled to the first end of the elongate line and removably connected to the first end accepting aperture; and a second hook member coupled to the second end of the elongate line.

4. The fall arrest safety net arrangement of claim 3 wherein the first hook member comprises a carabineer.

5. The fall arrest safety net arrangement of claim 4 wherein the second hook member comprises a carabineer.

6. The fall arrest safety net arrangement of claim 1 wherein the first thickness of the wire strand is from 0.5 millimeters to 1.0 millimeters and the second thickness of said elongate line is from 1.5 millimeters to 2.0 millimeters.

7. The fall arrest safety net arrangement of claim 1 wherein the choker fitting includes:

first and second horizontal edge surfaces extending between the upper surface and the lower surface, the first horizontal edge surface parallel to the second horizontal edge surface, and first and second vertical edge surfaces extending between the upper surface, the first vertical edge surface parallel to the second vertical edge surface and perpendicular to the first horizontal edge surface, and wherein the plurality of line accepting apertures includes a first line accepting aperture, a second line accepting aperture and a third line accepting aperture, the first line accepting aperture spaced a first distance from the first horizontal edge surface and a second distance from the first vertical edge surface, the second line accepting aperture spaced a third distance from the first horizontal edge surface and the second distance from the first vertical edge surface, and the third line accepting aperture spaced the third distance from the first horizontal edge surface and a fourth distance from the first vertical edge surface.

8. The fall arrest safety net arrangement claim 7 and further comprising:

a pair of locator tabs mounted on the wire strand in spaced apart relationship, each of the locator tabs comprising:

a body member having a first side and a second side opposite the first side;

a clamping member coupled to the first side of the body member, the clamping member having a pair of legs, one of the legs clamping a first portion of the wire strand to the first side of the body member and the other leg clamping a second portion of the wire strand to the first side of the body member.

9. The fall arrest safety net arrangement of claim 8 and further comprising:

a first hook member coupled to the first end of the elongate line and removably connected to the first end accepting aperture; and a second hook member coupled to the second end of the elongate line.

10. The fall arrest safety net arrangement of claim 9 wherein the first thickness of said wire strand is from 0.5 millimeters to 1.0 millimeters and the second thickness of said elongate line is from 1.5 millimeters to 2.0 millimeters.

11. The fall arrest safety net arrangement of claim 10 wherein the first hook member comprises a carabineer and the second hook member comprises a carabineer.

12. The fall arrest safety net arrangement of claim 1 wherein the wire strand is turned back upon itself to form the eyes at the mouth and a second plurality of eyes at the closed end, each eye at the mouth being fixed by fastenings to adjacent eyes on either side thereof, and each eye of the second plurality of eyes at the closed end being fixed by fastenings to adjacent eyes on either side thereof.

13. The fall arrest safety net assembly of claim 12 wherein the fastenings joining the eyes at the closed end are more closely spaced along the wire strand than the fastenings joining the eyes at the mouth.

14. The fall arrest safety net assembly of claim 1 wherein one of the surfaces of the choker fitting includes a marking located adjacent a blank area where a date can be marked.

* * * * *